US005322096A

United States Patent [19]

Tetenborg et al.

[11] Patent Number: 5,322,096

[45] Date of Patent: Jun. 21, 1994

[54] FILLING DEVICE

[75] Inventors: Konrad Tetenborg; Heinz Eschmann, both of Lengerich, Fed. Rep. of Germany

[73] Assignee: Windmoller & Holscher, Lengerich, Fed. Rep. of Germany

[21] Appl. No.: 994,751

[22] Filed: Dec. 22, 1992

[30] Foreign Application Priority Data

Dec. 23, 1991 [DE] Fed. Rep. of Germany ..... 4142828
Mar. 20, 1992 [DE] Fed. Rep. of Germany ..... 4209117

[51] Int. Cl.[5] ..... B65B 1/04; B65B 3/04

[52] U.S. Cl. ..... 141/93; 141/10; 141/314; 251/298

[58] Field of Search ..... 141/10, 59, 65, 93, 141/114, 314; 251/298, 299

[56] References Cited

U.S. PATENT DOCUMENTS 3,260,285 7/1966 Vogt ..... 141/59
4,300,600 11/1981 Tetenborg et al. ..... 141/114
4,526,214 7/1985 McGregor ..... 141/93
4,537,013 8/1985 Tetenborg et al. ..... 141/93
4,969,494 11/1990 Chefson ..... 141/93

*Primary Examiner*—Henry J. Recla
*Assistant Examiner*—Steven O. Douglas
*Attorney, Agent, or Firm*—Keck, Mahin & Cate

[57] ABSTRACT

A filling device for bulk materials includes a filling hopper, a housing surrounding an open end of the filling hopper and two hopper outlet doors which are pivoted in the the housing. In order to achieve the object of further developing the filling hopper so as to enable loss-free operation to take place, the filling hopper or, respectively, a casing surrounding the same has an external encircling section. Furthermore rubber sealing strips are provided on the hopper outlet doors, which come into sealing engagement with the encircling section when the hopper outlet doors are moved by a control system into the open position thereof.

5 Claims, 4 Drawing Sheets

FILLING DEVICE

FIELD OF THE INVENTION

The present invention relates to a filling device for bulk materials comprising a filling hopper, a housing surrounding an open end of the filling hopper and two hopper outlet doors which are pivoted in the said housing.

BACKGROUND OF THE INVENTION

Such filling devices are for instance utilized for the filling of previously weighed out quantities of bulk materials into sacks. In this case it is possible for the bulk material, dependent on its granule size, to have a pronounced tendency to form dust.

Thus in the case of filling devices of this type it has been found that between the upper end of the hopper outlet doors and the open end of the filling hopper, which when the hopper outlet doors are open come into the position alongside each other, approximately 1% by weight of the bulk material is lost, for example when working with pulverulent PVC. This means that when 100 sacks are filled the contents of a whole sack are lost.

SUMMARY OF THE INVENTION

One object of the present invention is to provide a filling device of the type initially mentioned which substantially prevents such losses on filling.

In accordance with the invention the object is to be attained since the filling hopper or a part surrounding it has an encircling section on its outer side and the hopper outlet doors have rubber sealing strips thereon, which when the hopper outlet doors are moved into the open position, make sealing engagement with the encircling section. Owing to these features in accordance with the invention the intermediate space between the filling hopper and the hopper outlet doors extending the same is shut off in a dust-proof manner with the result that the losses occurring in the prior art equipment are prevented.

Within the hopper outlet doors it is possible to arrange sheet metal guide, baffle and sealing elements in order to shut off the open end of the filling hopper. This means that by a suitable control action on its outlet doors the hopper may be closed down if the filling device should cease operating.

In the case of filling devices able to be sealed off in accordance with the invention clogging or the formation of plugs may occur in the tapering part of the hopper. The latter furthermore function to keep the surroundings as free of dust as possible. In order to prevent such clogging and stoppages it has already been proposed to provide a dust extraction device on the housing encircling the end of the filling hopper like a hood. This known dust extracting device does however suffer from the disadvantage that the dust-laden air has to be cleaned, for example by the use of cyclones in order to avoid losses of the bulk material and thus not to contaminate the environment.

In accordance with a further aspect of the invention the filling hopper of the type initially mentioned is therefore to be further developed in such a manner that stoppages or the formation of plugs is prevented without air laden with dust having to be drawn off.

In accordance with a particularly advantageous working embodiment of the invention, which is claimed as a subcombination, at least one dust balancing or equalizing duct is provided which extends from the inlet end of the filling hopper to the outlet end of the filling hopper. With this dust balancing device it is possible to tackle or prevent blockages since suction, produced in the inlet part of the filling hopper owing to the sinking bulk material, is shunted through the dust balancing duct to the open end part of the filling hopper with the result that such suction acts on the plug of dust being formed in the tapering part of the filling hopper and thus prevents any formation of a bridge, which would shut off the filling hopper, composed of the bulk material in the hopper.

The at least one dust balancing duct may open into a casing surrounding the lower end of the filling hopper. In this case the encircling section, with which the rubber sealing strip of the hopper outlet doors can come into engagement, is arranged on the outer side of this casing.

Further advantageous developments and convenient forms of the invention will be understood from the following detailed account of one embodiment thereof in conjunction with the accompanying drawings.

DETAILED DESCRIPTION OF THE PREFERRED EMBODIMENTS

Figure 1:
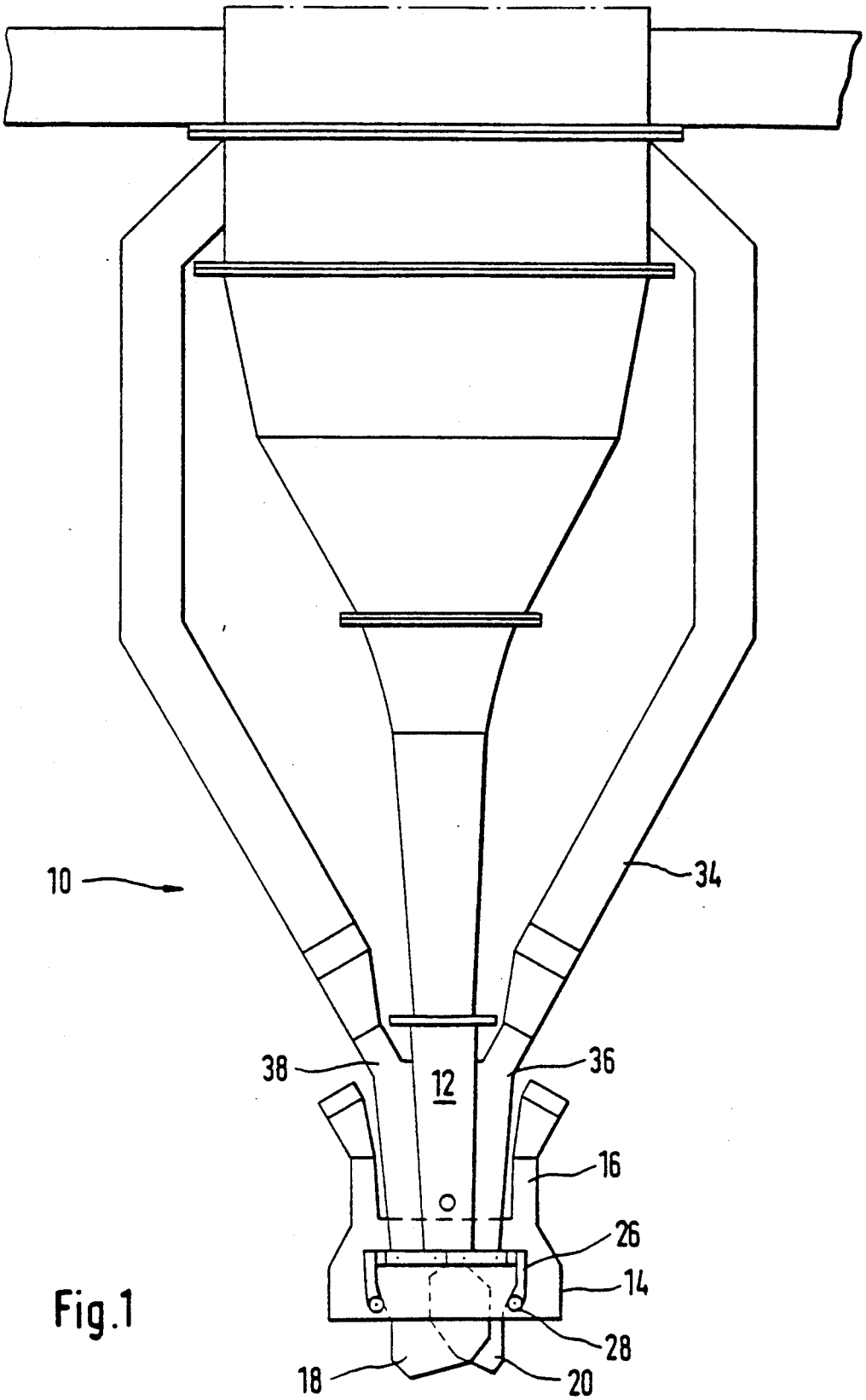
FIG. 1 is an overall view of the filling device in accordance with the invention.

As shown in FIG. 1, the filling hopper 12 constitutes the main part of the filling device 10. The filling hopper 12 is composed of a plurality of segments, which initially only have minor taper. In its lower part the filling hopper 12 is however tapered down to a tubular end part. The filling hopper 12 has a rectangular cross section. In the lower part it is surrounded by a hood-shaped housing 14. In the case of the working embodiment in accordance with FIG. 1 and FIG. 2 unions of a dust extraction system 16 are connected with the hood 14. Via a suction fan, not illustrated in detail here, it is possible for the dust-laden atmosphere to be drawn off adjacent to the outlet end of the filling hopper 12.

The outlet end of the filling hopper 12 has an encircling casing 38 extending parallel to the filling hopper 12 and into which two dust balancing ducts 34 open. These dust balancing ducts 34 extend essentially in parallelism to the filling hopper to open into the inlet end of the filling hopper.

Figure 2:
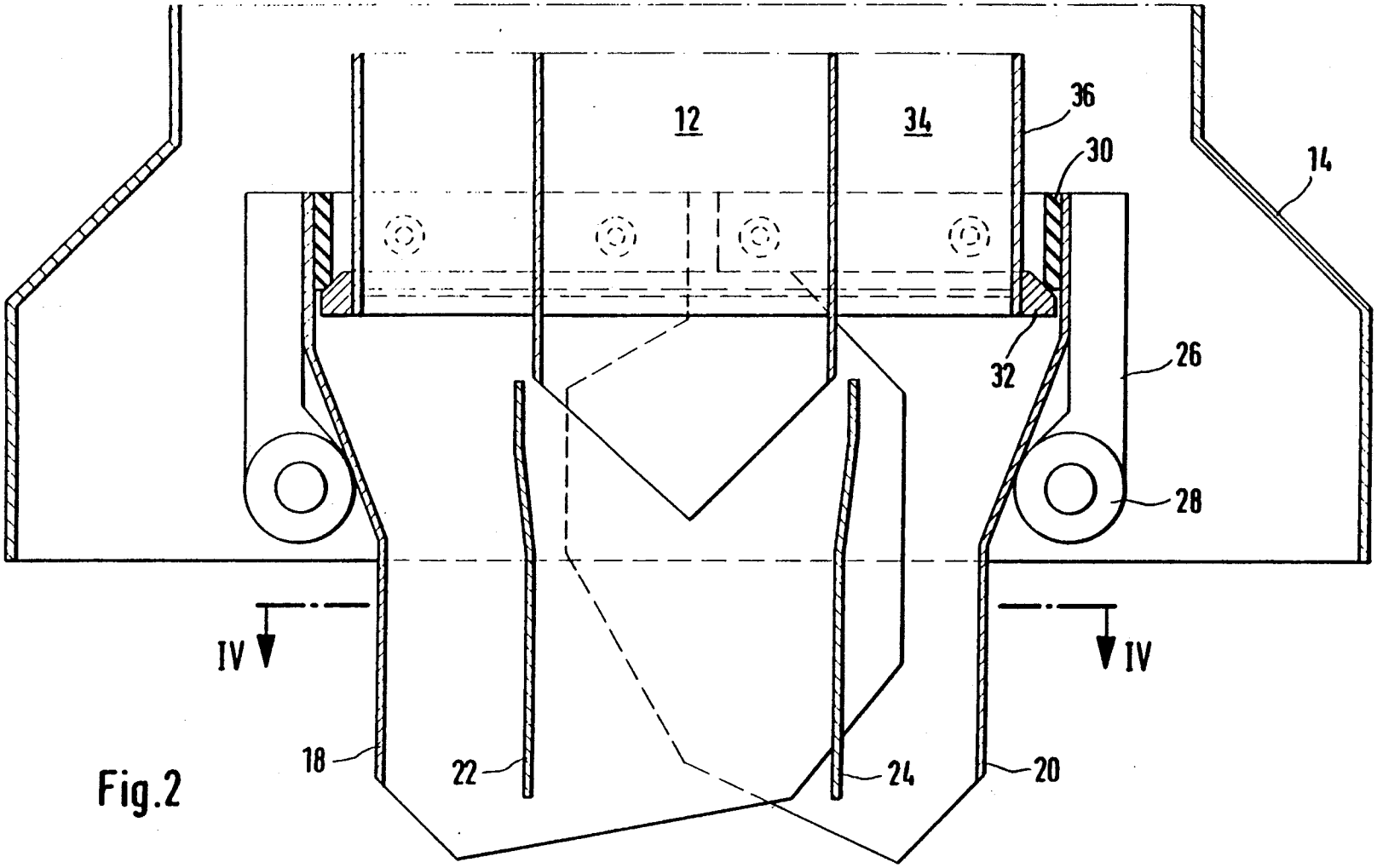
FIG. 2 is a section taken through a part of the filling device with the hopper outlet doors moved into the open setting.
Figure 3:
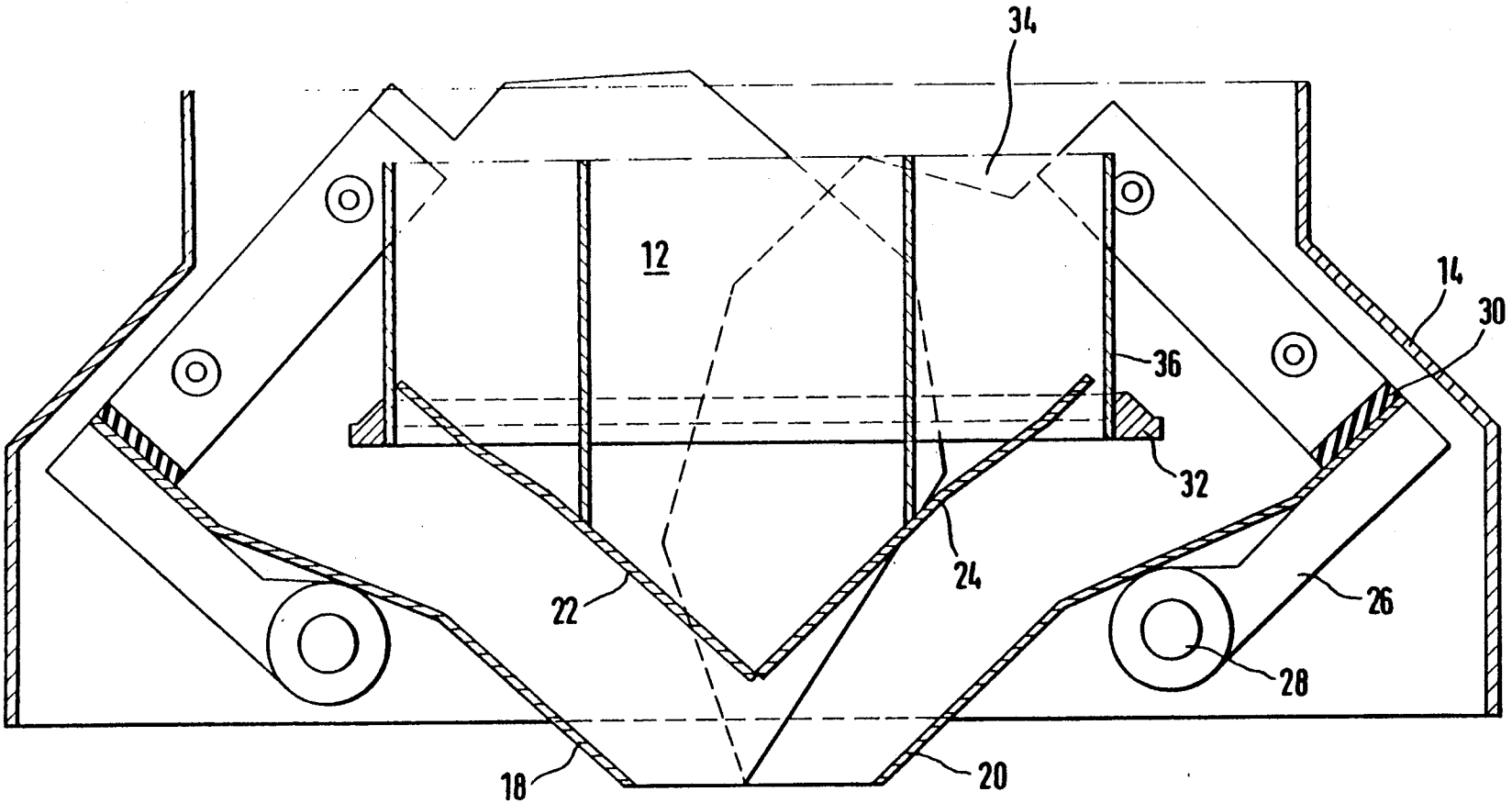
FIG. 3 is a section corresponding to FIG. 2 but with the hopper outlet doors moved into the closed setting thereof.
Figure 4:
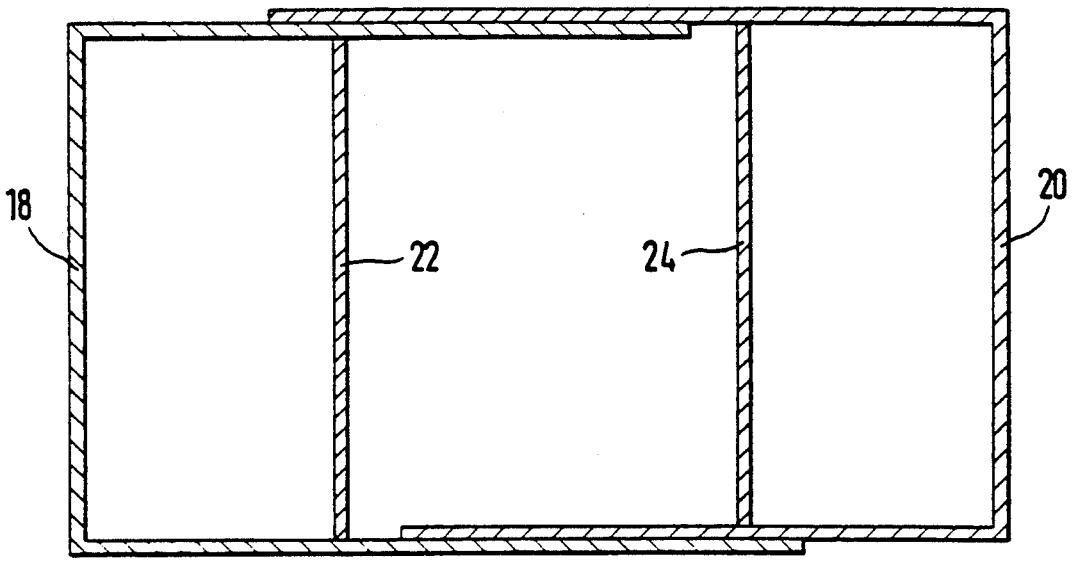
FIG. 4 is a cross section taken on the section IV—IV of FIG. 2.

As shown in FIGS. 2 and 3 more particularly in detail, two hopper outlet doors 18 and 20 or flaps are pivotally mounted by means of arms 26 adapted to rock on pivot shafts 28. These two hopper outlet doors are so designed that they overlap partly sideways. The respectively overlapping parts of the lateral wall are shown in broken lines in FIGS. 2 and 3 It is to be seen in detail from the cross section of FIG. 4 how the left hopper outlet door 18 and the right hopper outlet door 20 laterally overlap each other. Within the hopper outlet doors or flaps there is respectively a sheet metal guide and sealing element 22 and, respectively, 24. In the opened position of the hopper outlet doors 18 and 20 the sheet metal guide and sealing elements constitute an extension of the lower end of the filling hopper 12 (see FIG. 2). In the position of the hopper outlet doors 18 and 20 in which they are closed by a control system the sheet metal guide and sealing elements 22 and 24 shut off the filling hopper 12 generally as depicted in FIG. 3.

When the hopper outlet doors are moved by the control system into the open setting their end part pointing towards the filling hopper is in parallelism to the filling hopper 12 and consequently simultaneously to the surrounding casing 36 thereof as shown in FIG. 2. Externally on the casing 36 there is a partly chamfered encircling section 32. The oblique surface of the encircling section 32 is engaged by the sealing rubber strips 30 (see FIG. 2) which are provided on the end parts of the hopper outlet doors 18 and 20. This means that the filling losses occurring during the filling operation are substantially reduced.

What is claimed is:

1. A filling device (10) for bulk materials comprising a filling hopper (12), a housing (14) surrounding an open end of the filling hopper and two hopper outlet doors (18 and 20) which are pivoted about pivot shafts (28) in the said housing, characterized in that the filling hopper (12) has an encircling section (32) on its outer side and the hopper outlet doors (18 and 20) have rubber sealing strips (30) thereon, which when the hopper outlet doors (18 and 20) are moved into the open position make sealing engagement with the encircling section (32).

2. The filling device as claimed in claim 1, characterized in that within the hopper outlet doors (18 and 20) guide and sealing surfaces (22 and 24) are arranged for sealing off the open end of the filling hopper (12).

3. The filling device as claimed in claim 1, characterized by a dust extracting means (16) connected with the housing (14).

4. A filling device (10) for bulk material comprising a filling hopper (12) having an upper portion including an inlet part and a lower portion including an outlet end, which at the outlet end thereof is surrounded by a housing (14), in which two hopper outlet doors (18 and 20) are pivotally mounted, characterized by at least one dust balancing duct (34) extending in fluid communication from the inlet part of the filling hopper (12) to the outlet end of the filling hopper (12).

5. The filling device as claimed in claim 4, characterized in that the at least one dust balancing duct (34) opens into a casing (36) surrounding the lower portion of the filling hopper (12) and in that an encircling section (32) is arranged on an outer side of the casing (36).

* * * * *